US008915902B2

(12) United States Patent
Reynolds et al.

(10) Patent No.: US 8,915,902 B2
(45) Date of Patent: Dec. 23, 2014

(54) INTER VIAL TRANSFER SYSTEM

(75) Inventors: David L. Reynolds, Bromont (CA); Daniel MacDonald, Bromont (CA); Yan Tremblay, Orford (CA)

(73) Assignee: Duoject Medical Systems Inc., Bromont, Quebec (CA)

( * ) Notice: Subject to any disclaimer, the term of this patent is extended or adjusted under 35 U.S.C. 154(b) by 153 days.

(21) Appl. No.: 12/925,924

(22) Filed: Nov. 1, 2010

(65) Prior Publication Data

US 2011/0106045 A1 May 5, 2011

Related U.S. Application Data

(60) Provisional application No. 61/280,169, filed on Oct. 30, 2009.

(51) Int. Cl.
*A61J 1/20* (2006.01)

(52) U.S. Cl.
CPC ..... *A61J 1/2096* (2013.01); *A61J 2001/2055* (2013.01); *A61J 2001/2013* (2013.01); *A61J 2001/2065* (2013.01)
USPC ..... 604/413; 604/403; 604/411

(58) Field of Classification Search
None
See application file for complete search history.

(56) References Cited

U.S. PATENT DOCUMENTS

| | | | | |
|---|---|---|---|---|
| 3,563,373 | A * | 2/1971 | Paulson | 206/229 |
| 4,997,371 | A * | 3/1991 | Fischer | 433/90 |
| 5,171,214 | A * | 12/1992 | Kolber et al. | 604/82 |
| 6,945,417 | B2 * | 9/2005 | Jansen et al. | 215/249 |
| 7,077,835 | B2 * | 7/2006 | Robinson et al. | 604/413 |
| 2004/0024354 | A1 * | 2/2004 | Reynolds | 604/87 |
| 2004/0116892 | A1 * | 6/2004 | Burroughs et al. | 604/414 |
| 2005/0113747 | A1 * | 5/2005 | Moir | 604/87 |
| 2005/0137566 | A1 * | 6/2005 | Fowles et al. | 604/412 |
| 2006/0025747 | A1 * | 2/2006 | Sullivan et al. | 604/411 |
| 2007/0060904 | A1 * | 3/2007 | Vedrine et al. | 604/411 |
| 2007/0078428 | A1 * | 4/2007 | Reynolds et al. | 604/411 |
| 2008/0172001 | A1 * | 7/2008 | Reynolds et al. | 604/232 |

* cited by examiner

*Primary Examiner* — Stephen Crow
*Assistant Examiner* — Andrew S Lo
(74) *Attorney, Agent, or Firm* — Eric Fincham

(57) ABSTRACT

A transfer system suitable for medicaments comprising a vial socket, a housing having first and second open ends with the first open end being releasably connected to the vial socket, a needle hub mounted within the housing, a needle having first and second piercing ends mounted in the needle hub, a vial having a neck and a body, the vial being inserted in the vial socket and being non removably retained therein, a cartridge having a plunger sealing an open end thereof and a septum located at an opposite end of the cartridge, and an activation cap for causing the needle to penetrate a septum of the vial and the septum of the cartridge to permit transfer of components therebetween.

8 Claims, 6 Drawing Sheets

INTER VIAL TRANSFER SYSTEM

The present invention claims priority on U.S. Application Ser. No. 61/280,169 filed Oct. 30, 2009.

FIELD OF THE INVENTION

The present invention relates to fluid transfer assemblies generally used for pharmaceutical delivery systems and to a method for reconstituting a pharmaceutical preparation.

BACKGROUND OF THE INVENTION

Traditionally, a pharmaceutical preparation has been dispensed using devices such as syringes. The syringe is usually filled manually by aspirating a liquid pharmaceutical component from a pharmaceutical vial having a neck with a penetrable closure into the syringe through a needle that penetrates the penetrable closure. The method of manually filling the syringe typically includes the steps of drawing air into the body of the syringe until the volume of air in the body approximately equals the volume of pharmaceutical component to be loaded into the syringe and subsequently inserting the needle through the penetrable closure into the vial.

Many pharmaceutical preparations must be distributed and stored as two or more separate components—a typical example would be a lyophilized component and a liquid component such as a diluent. The two components are mixed just prior to administration.

Some medical treatments require the administration of a pharmaceutical composition wherein one of the components of the pharmaceutical composition can be considered to be dangerous due to toxicity or other factors. In other words, the toxic component may have to be diluted in order to provide a composition having the desired properties. Naturally, great care must be exercised when using such toxic components and access to the same needs to be limited.

SUMMARY OF THE INVENTION

It is an object of the present invention to provide a fluid transfer assembly for pharmaceutical delivery systems wherein access to the individual components is minimized.

It is a further object of the present invention to provide a method for the preparation of a pharmaceutical composition comprised of two or more separate components which are stored separately.

According to one embodiment of the present invention, there is provided a transfer system comprising a vial socket, a housing having first and second open ends, the first open end being releasably connected to the vial socket, a needle hub mounted within the housing, a needle having first and second piercing ends mounted in the needle hub, a vial having a neck and a body, the vial being inserted in the vial socket, the vial being non removably retained in the releasably connected vial socket, a cartridge having a plunger sealing an open end thereof, a septum located at an opposite end of the cartridge, and an activation cap for causing the needle to penetrate a septum of the vial and the septum of the cartridge to permit transfer of components therebetween.

According to a further embodiment of the present invention, there is provided a transfer system comprising a housing having first and second open ends, wherein the first open end is configurated to be releasably connected to a vial socket, a needle hub mounted within the housing, a needle having first and second piercing ends mounted in the needle hub, a cartridge having a plunger sealing an open end thereof, a septum located in an opposite end of the cartridge, and an activation cap for causing the needle to penetrate a septum of a vial held in the vial socket and the septum of the cartridge to permit transfer of components therebetween.

The vial and the vial socket are preferably provided in an arrangement wherein the vial cannot be removed from the vial socket. This is particularly useful when the components or ingredients in the vial are toxic or in the alternative, when it is important that the contents be accessed for a specific use—i.e. a topical application and not for injection.

Conventional vials may be used—i.e. those having a glass body and a restricted neck area. Preferably, the vial socket will have latches which will engage both the neck and bottom of the vial to ensure that the vial is securely retained by the vial socket. To this end, the vial socket may utilize an outer housing which surrounds the latches or clasps to prevent access thereto.

The housing of the transfer system is designed to receive a conventional cartridge which will carry the other one of the components to be mixed. Usually, the vial will contain the dry component and the cartridge will contain the liquid component—typically a diluent. However, other arrangements may be utilized including the mixing of two liquids.

The cartridge will have a plunger which seals the open end with a septum located at the opposite end of the cartridge. This is a substantially conventional arrangement known in the art.

A needle hub is provided within the housing and, in the preferred embodiment, comprises two different disengageable members. Each of the members will have a portion of the needle, with each portion of the needle having a piercing end. After activation of the transfer system, one end of the needle hub will be retained by the vial with the other end being mounted on the cartridge and forming a fluid passageway. It is the member which is retained by the cartridge which will form the ultimate dispensing outlet. To this end, the two portions are temporarily secured together and may comprise a tapered dispensing end fitting within the mating component.

While the present invention illustrates a topical application of the mixture, other arrangements may be utilized.

In preferred embodiments of the invention, the vial is preferably retained within the vial socket with a tamper evident arrangement if access to the vial by other means is attempted.

Preferably, the cartridge is also retained within the housing in a non removable manner. In one embodiment, the needle hub is formed of first and second members which are designed to fit together. After mixing of the components, one of the members forming the needle hub may be utilized for dispensing the composition from the cartridge. In topical applications, the dispensing tip would be specifically designed not to accept a needle.

In one particular embodiment, the needle may have an offset arrangement such that access through the needle to the vial is prevented. If desired, a tamper evident seal may be provided between the point of joinder of the vial socket and housing.

Other preferred arrangements will be seen from the accompanying drawings and description thereof.

BRIEF DESCRIPTION OF THE DRAWINGS

Having thus generally described the invention, reference will be made to the accompanying drawings illustrating embodiments thereof, in which.

DETAILED DESCRIPTION OF THE INVENTION

Figure 1:
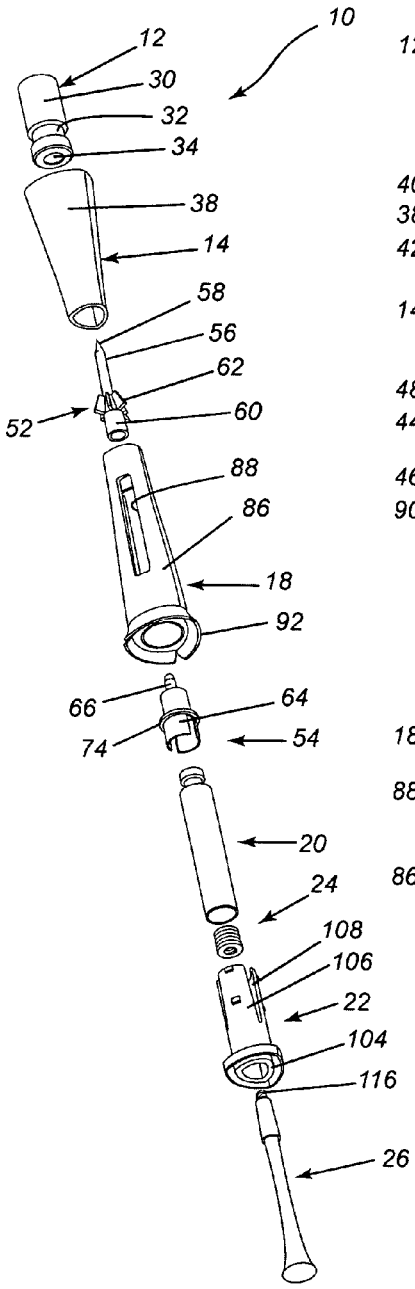
FIG. 1 is an exploded view of a transfer system according to an embodiment of the present invention.

Referring to the drawings in greater detail and by reference characters thereto, there is illustrated a transfer system which is generally designated by reference numeral 10.

Figure 3:
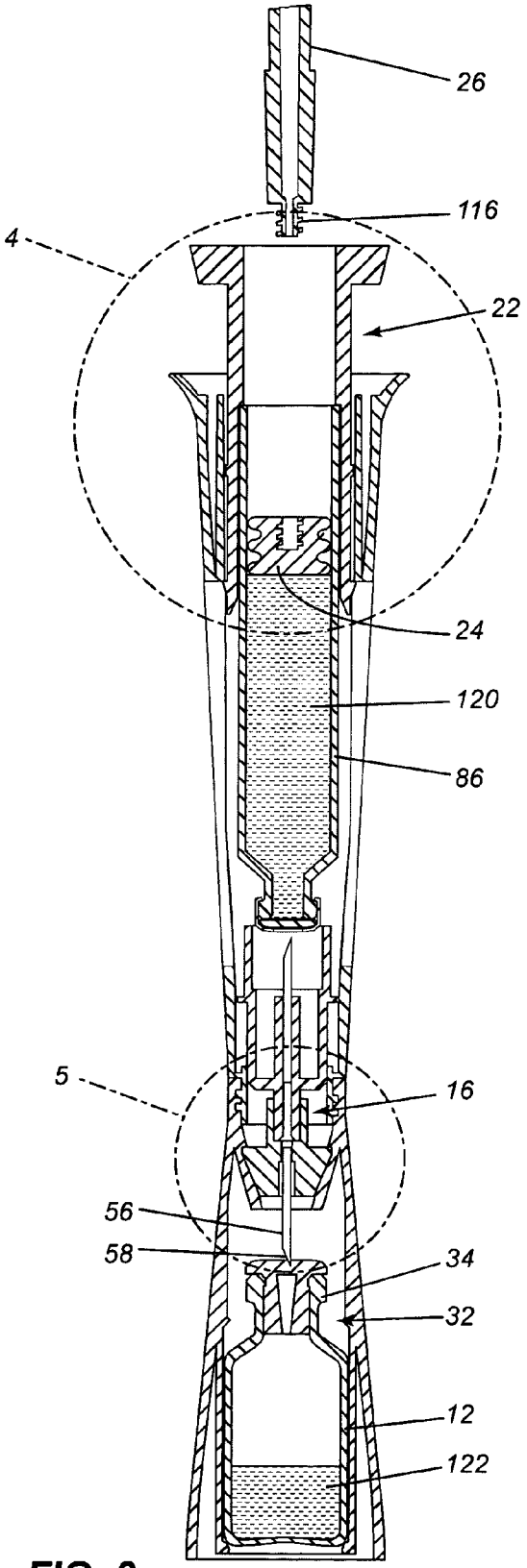
FIG. 3 is a cross-sectional view of a transfer system prior to activation.

A vial generally designated by reference numeral 12 is associated with the transfer system which also includes a vial socket 14 designed to receive vial 12. Transfer system 10 also includes a needle hub generally designated by reference numeral 16 (FIG. 3). A housing 18 is designed to extend about a cartridge 20. The proximal end of transfer system 10 includes an activation cap 22. A plunger 24 is designed to fit within the open end cartridge 20 while a plunger rod 26 is engageable with plunger 24 as will be discussed hereinbelow.

In describing various components, the terms "proximal" and "distal" are utilized. In each instance, the term proximal refers to the end closest to the hand of the user while the term distal refers to the end furthest removed from the hand of the operator.

Vial 12 may be any conventional vial known to those skilled in the art or alternatively, in certain applications, may be of a non standard size when it is desired to use some specialized components for the vial. Vial 12 will include a body portion 30 having a restricted neck portion 32 over which extends a pierceable septum 34.

Vial socket 14 is, in the illustrated embodiment, of a somewhat overall triangular configuration having a plurality of lower outer wall segments 38 each of which is somewhat arcuate in configuration and tapers inwardly from a distal end to meet upper wall segments 44. Lower wall segments 38 define the lower body and there are provided a plurality of inner legs 40 each having inwardly extending flanges for gripping vial 12 at their distal end and being spaced from the wall by means of ribs 42 which extend between inner legs 40 and lower outer wall segments 38.

Figure 2:
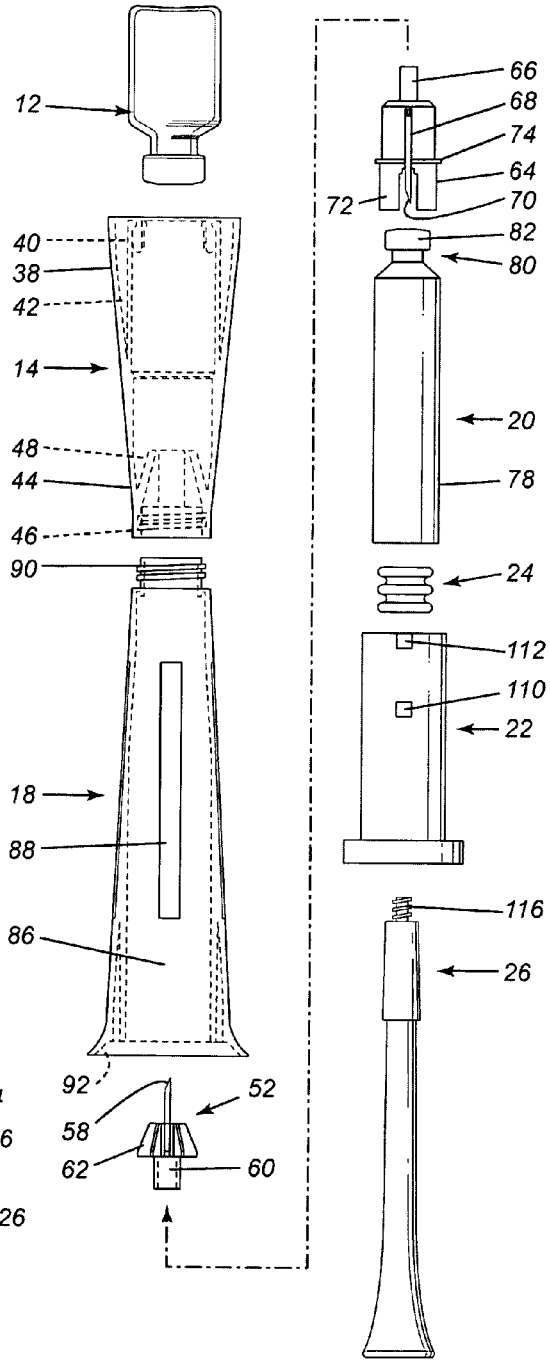
FIG. 2 is an enlarged exploded view of the transfer system of FIG. 1 with dash lines showing the internal structure of certain components.

Vial socket 14 also includes upper wall segments 44 which define, at a proximal end thereof, a female thread opening 46. A plurality of flanges 48 extend downwardly as may be seen in FIG. 2.

Needle hub 16 comprises a distal member 52 and a proximal member 54 which are designed to fit together. Distal member 52 includes a piercing member 56 having a piercing tip 58. At its proximal end, distal member 52 has a tubular end 60. A plurality of fins 62 extend circumferentially of distal member 52.

Proximal member 54 includes a body portion 64 having a tubular portion 66 which is designed to engage with tubular end 60 of distal member 52. A piercing member 68 is secured to body portion 64 and has a piercing tip 70.

Proximal member 54 also includes a pair of legs 72 with an annular ring 74 situated proximate the middle of body 64.

Cartridge 20 includes a body 78 which has an open end designed to receive plunger 24. A pierceable septum 82 is arranged at the top of body 78 adjacent neck 80. Housing 18, in the illustrated embodiment, includes a plurality of wall segments 86, there being three such wall segments 86 in the illustrated embodiment. In each wall segment 86 there is provided a slot 88 to provide visual access to the interior. Housing 18 also includes a plurality of male threads 90 at the distal end thereof. Housing 18 also has a flared proximal end 92.

Activation cap 22 has a proximal end wall 104 and a side wall 106 with slots 108 formed therein. A first set of protrusions 110 are designed to engage housing 18 when the activation cap has been activated while a second set of protrusions 112 engage housing 18 prior to activation.

Plunger rod 26 is provided with male threads 116 for screwthreadably engaging plunger 24.

In operation, vial 12 and vial socket 14 are supplied as a unit with the vial inserted therein and retained in a non removable manner. Similarly, cartridge 20 is mounted within housing 18 and activation cap 22 inserted in the proximal end of housing 18. Activation cap 18 is held in a non removable position. Housing 18 is screwthreadably engaged with vial socket 14 by means of respective threads 90, 46.

Figure 4:
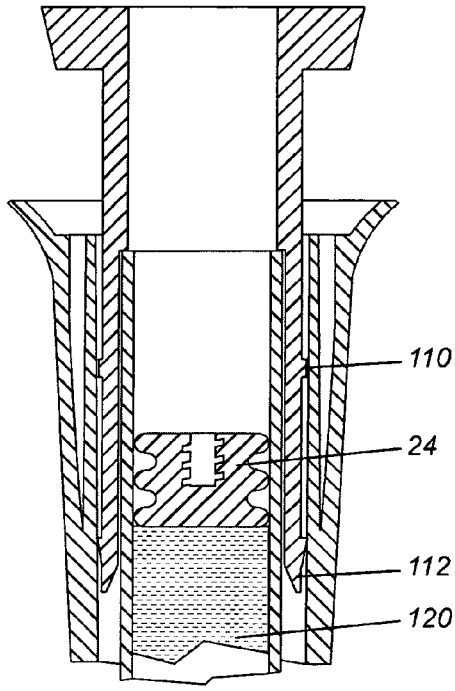
FIG. 4 is an enlarged view of that portion of the transfer system designated by dot dash lines 4.
Figure 5:
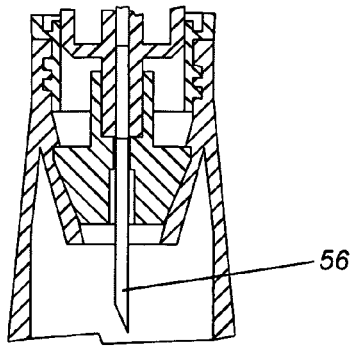
FIG. 5 is an enlarged view of that portion of the transfer system indicated by dot dash lines 5.
Figure 6:
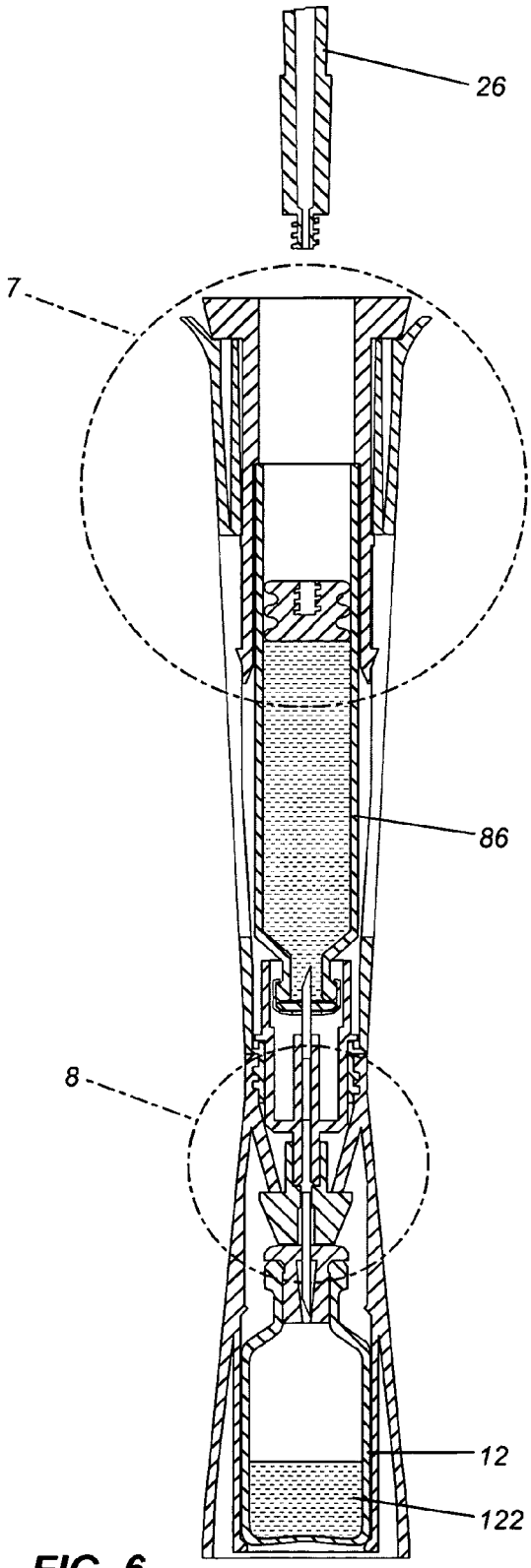
FIG. 6 is a cross-sectional view of the transfer system after activation.
Figure 7:
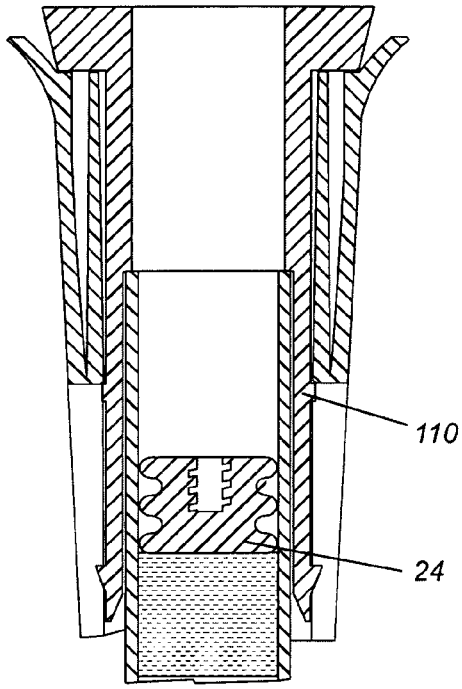
FIG. 7 is an enlarged view of that portion of the transfer system designated by dot dash lines 7.
Figure 8:
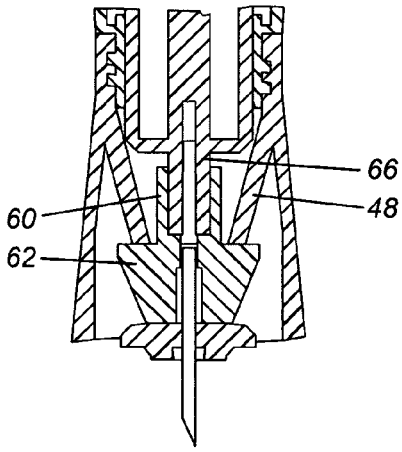
FIG. 8 is an enlarged view of that portion of the transfer system designated by dot dash lines 8.
Figure 9:
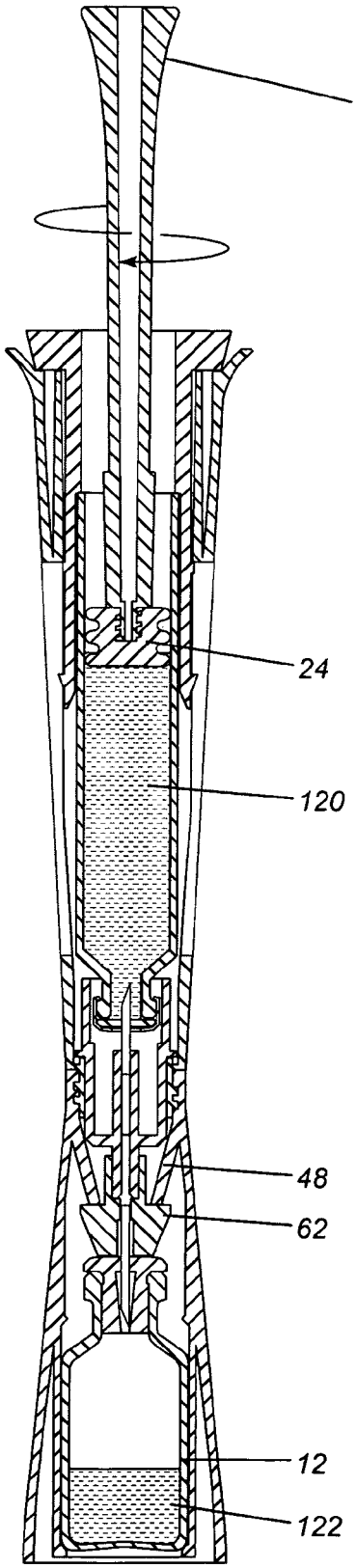
FIG. 9 is a cross-sectional view illustrating attachment of the plunger rod for transfer of one of the components.
Figure 10:
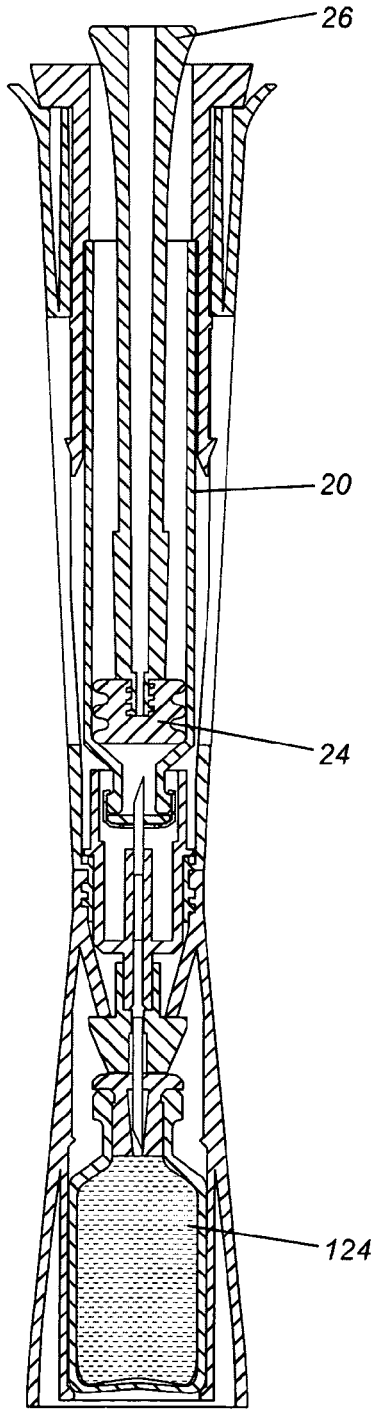
FIG. 10 is a cross-sectional view illustrating transfer of the components.

As illustrated in FIG. 3, activation cap 22 extends exteriorly of housing 18. For use, activation cap 22 is depressed as shown in FIG. 4 thereby leading to a piercing of septum 34 of vial 12 and septum 82 of cartridge 20. Plunger rod 26 is then engaged with plunger 24 by means of their respective screwthreads and pressure is exerted on plunger 24 to transfer the diluent 120 to mix with a component 122 in vial 12. This position is illustrated in FIG. 10.

Figure 11:
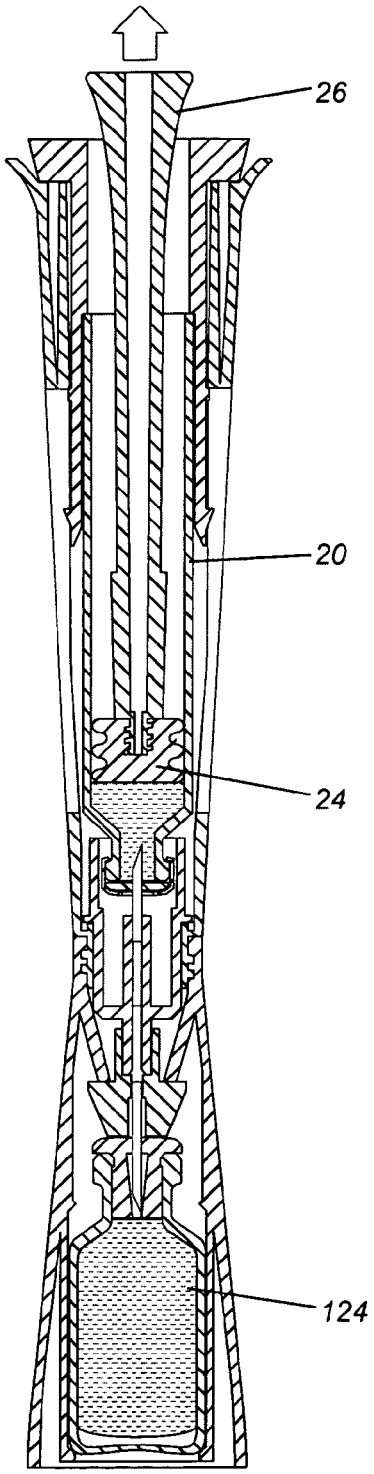
FIG. 11 is a cross-sectional view indicating the beginning of aspiration of the mixture back into the cartridge.
Figure 12:
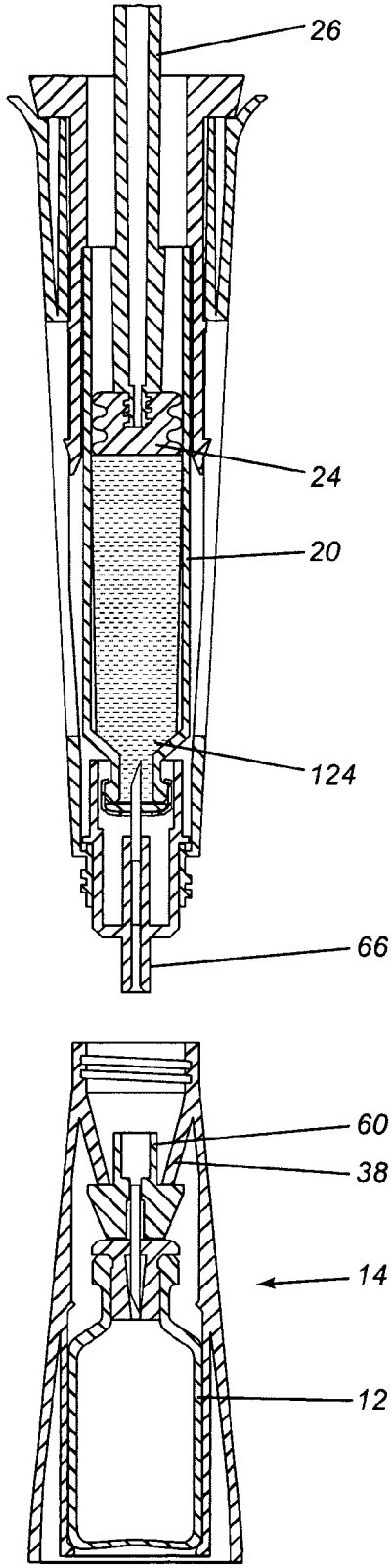
FIG. 12 is a cross-sectional view illustrating separation of the vial socket from the housing holding the cartridge.
Figure 13:
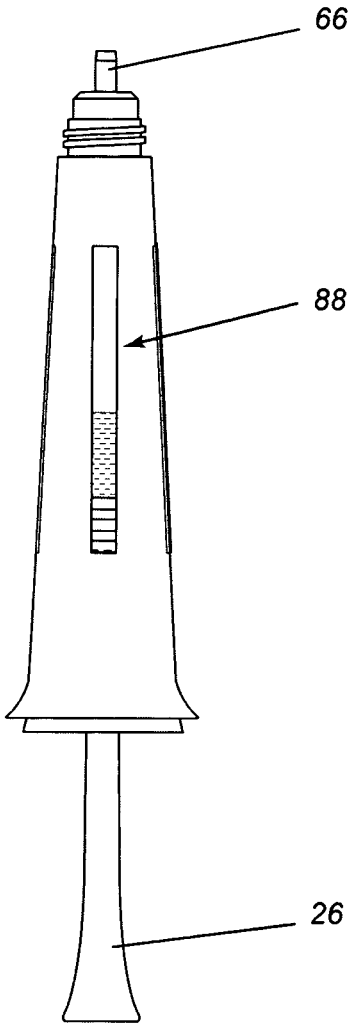
FIG. 13 is a side view illustrating the cartridge ready for application.

At this point in time, a gentle shaking of the vial 12 may occur to ensure mixing of the components, subsequently the mixture 124 is aspirated into cartridge 20 as shown in FIGS. 11 and 12. The housing is then removed from vial socket 14 and the mixture 124 is then dispensed as required. In the illustrated embodiment, tubular portion 66 forms the dispensing member and is specifically designed to apply mixture 124 in a topical manner. To ensure that the mixture is not injected, member 66 would be of a non standard size and/or configuration not designed to accepted a needle. However, in certain applications, the attachment of a needle may be desired and appropriate configurations would be provided.

Figure 15:
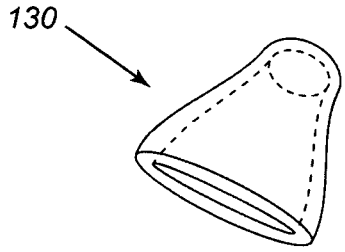
FIGS. 14 and 15 are perspective views showing different applicator tips.
Figure 14:
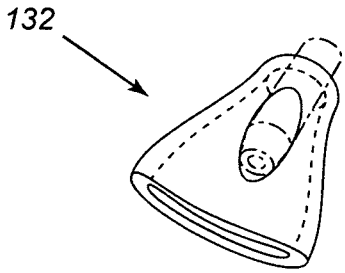

FIGS. 14 and 15 illustrate different dispensing tips 130 and 132 which may be utilized for topical applications.

We claim:

1. A transfer system comprising:

a vial socket;

a housing having first and second open ends, said first open end being releasably connected to said vial socket;

a needle hub mounted within said housing, said needle hub being formed of first and second disengageable members, said first disengageable member terminating in a dispensing outlet, said dispensing outlet being configured so as to not accept a needle which could be used for injection;

a needle having first and second piercing ends mounted in respective first and second disengageable members of the needle hub, said second disengageable member being retained within said vial socket to prevent access to said second piercing end when said housing and vial socket are separated;

a vial having a neck and a body, said vial being inserted in said vial socket, said vial being non removably retained in said releasably connected vial socket;

a cartridge having a plunger sealing an open end thereof, a septum located at an opposite end of said cartridge; and an activation cap for causing said needle to penetrate a septum of the vial and said septum of the cartridge to permit transfer of components therebetween;

said housing having at least one slot formed therein, said activation cap having first and second protrusions formed thereon, said first protrusion being located proximate an end of said activation cap, said second protrusion being axially spaced from said first protrusion, the arrangement being such that said first protrusion engages within said slot when said activation cap is in a preactivated state and said second protrusion engages within said slot when said activation cap has been activated.

2. The transfer system of claim 1 wherein said housing and said vial socket are screwthreadably engaged with each other.

3. The transfer system of claim 1 wherein after operation of said activation cap and reconstitution, the first disengageable member is retained by said vial socket and the second disengageable member is retained by said housing.

4. The transfer system of claim 1 wherein said slot in said housing forms a visual access area to permit viewing of said cartridge.

5. The transfer system of claim 1 further including a plunger rod engageable with said plunger.

6. The transfer system of claim 1 further including a topical applicator, said topical applicator being sized to fit on said dispensing outlet.

7. The transfer system of claim 1 further including at least two flanges extending along a side of said vial, each of said flanges having an inwardly extending lip to engage a bottom wall of said vial to thereby prevent removal of the vial from said vial socket, said housing being located exteriorly of said flanges to prevent access thereto.

8. The transfer system of claim 1 wherein said first disengageable member is non removably retained within said housing prior to activation of said activation cap.

* * * * *